US011815825B2

(12) United States Patent
Ito

(10) Patent No.: US 11,815,825 B2
(45) Date of Patent: Nov. 14, 2023

(54) IMAGE FORMING APPARATUS

(71) Applicant: CANON KABUSHIKI KAISHA, Tokyo (JP)

(72) Inventor: Shingo Ito, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/473,043

(22) Filed: Sep. 13, 2021

(65) Prior Publication Data

US 2022/0100117 A1 Mar. 31, 2022

(30) Foreign Application Priority Data

Sep. 30, 2020 (JP) ..... 2020-165945

(51) Int. Cl.
*G03G 15/043* (2006.01)
*G03G 15/20* (2006.01)
*G03G 15/00* (2006.01)

(52) U.S. Cl.
CPC ..... *G03G 15/043* (2013.01); *G03G 15/2039* (2013.01); *G03G 15/2042* (2013.01); *G03G 15/5025* (2013.01); *G03G 15/5087* (2013.01)

(58) Field of Classification Search
CPC ..... G03G 15/043; G03G 15/2039; G03G 15/2042
See application file for complete search history.

(56) References Cited

U.S. PATENT DOCUMENTS 4,532,552 A 7/1985 Uno
10,613,458 B2 * 4/2020 Kasuya ..... G03G 15/2039
2012/0114358 A1 * 5/2012 Sugiyama ..... G03G 15/04027 399/69
2015/0286174 A1 * 10/2015 Yamamoto ..... G03G 15/2039 399/69
2015/0365554 A1 * 12/2015 Kawana ..... H04N 1/04 358/474
2016/0266509 A1 * 9/2016 Sano ..... G03G 9/08711
2017/0060020 A1 * 3/2017 Ikari ..... G03G 15/043
2018/0074445 A1 * 3/2018 Nishida ..... G03G 15/2046
2018/0217541 A1 * 8/2018 Nomura ..... G03G 15/2039
(Continued)

FOREIGN PATENT DOCUMENTS

JP S58125064 A 7/1983
JP 2009223239 A 10/2009
(Continued)

*Primary Examiner* — Carla J Therrien
(74) *Attorney, Agent, or Firm* — ROSSI, KIMMS & McDOWELL LLP

(57) ABSTRACT

An image forming apparatus is used, which includes: a scanning unit that scans a surface of a photosensitive member with light and forms a latent image according to image data; a developing unit that supplies toner to the latent image to develop the latent image; a fixing unit that heats and fixes the toner image on a recording material; and a control unit that controls a fixing temperature based on the image data, wherein the control unit analyzes a printing ratio by dividing the image data into a plurality of regions in a main scanning direction when the scanning unit scans the surface of the photosensitive member with light, and determines the fixing temperature on the basis of the position in the main scanning direction and the printing ratio for each of the plurality of regions.

22 Claims, 13 Drawing Sheets

| | IMAGE1 | IMAGE2 | IMAGE3 | IMAGE4 |
|---|---|---|---|---|
| IMAGE (512x512) | AAAAAAA BBBBBBB CCCCCCC DDDDDDD |  |  |  |
| CONTINUITY C THRESHOLD DETERMI-NATION | N | Y | Y | N |
| COVERAGE RATIO R THRESHOLD DETERMINATION | N | N | Y | Y |
| IMAGE TYPE | 1 | 2 | 2 | 2 |

(56) References Cited

U.S. PATENT DOCUMENTS

| | | | | |
|---|---|---|---|---|
| 2018/0329335 | A1* | 11/2018 | Iida | G03G 15/04072 |
| 2019/0187595 | A1* | 6/2019 | Maenishi | G03G 15/2039 |
| 2019/0243292 | A1* | 8/2019 | Imaizumi | G03G 15/2039 |
| 2019/0317435 | A1* | 10/2019 | Yamashita | G03G 15/2042 |
| 2019/0324389 | A1* | 10/2019 | Jota | G03G 15/2039 |
| 2019/0332042 | A1* | 10/2019 | Okayasu | G03G 15/2039 |
| 2019/0346796 | A1* | 11/2019 | Imaizumi | G03G 15/2039 |
| 2019/0354047 | A1* | 11/2019 | Uchiyama | G03G 15/2039 |
| 2020/0310310 | A1* | 10/2020 | Shinji | G03G 15/2039 |
| 2020/0333732 | A1* | 10/2020 | Uchiyama | G03G 15/2017 |
| 2020/0333733 | A1* | 10/2020 | Tsuchihashi | G03G 15/2042 |
| 2020/0379383 | A1* | 12/2020 | Akamatsu | G03G 15/2039 |
| 2021/0063924 | A1* | 3/2021 | Ito | G03G 15/2039 |
| 2021/0191294 | A1* | 6/2021 | Nishida | G03G 15/205 |

FOREIGN PATENT DOCUMENTS

| | | | |
|---|---|---|---|
| JP | 2016000511 | A | 1/2016 |
| JP | 2016004231 | A | 1/2016 |
| JP | 2020124930 | A | 8/2020 |

* cited by examiner

| | IMAGE1 | IMAGE2 | IMAGE3 | IMAGE4 |
|---|---|---|---|---|
| IMAGE (512x512) | AAAAAAA<br>BBBBBBB<br>CCCCCCC<br>DDDDDDD |  |  |  |
| CONTINUITY C THRESHOLD DETERMI-NATION | N | Y | Y | N |
| COVERAGE RATIO R THRESHOLD DETERMINATION | N | N | Y | Y |
| IMAGE TYPE | 1 | 2 | 2 | 2 |

IMAGE A
abcat bcabc
abcat bcabc
abcat bcabc
abcat bcabc
abcat bcabc
abcat bcabc
abcat bcabc
abcat bcabc
abcat bcabc
FIG. 13A
IMAGE B
bcabcabca
bcabcabca
bcabcabca
bcabcabca
bcabcabca
bcabcabca
bcabcabca
bcabcabca
bcabcabca
FIG. 13B
IMAGE C
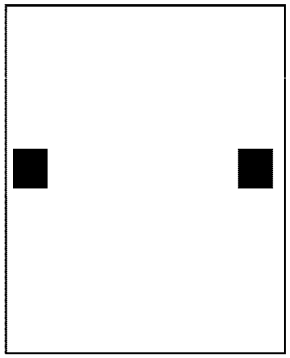
FIG. 13C
IMAGE D
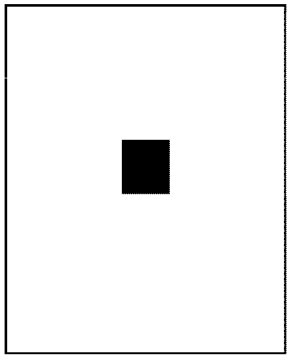
FIG. 13D
IMAGE E
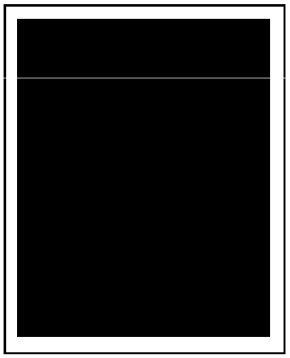
FIG. 13E

IMAGE FORMING APPARATUS

BACKGROUND OF THE INVENTION

Field of the Invention

The present invention relates to an image forming apparatus.

Description of the Related Art

An electrophotographic type image forming apparatus includes an optical scanner to expose a photosensitive member with light. The optical scanner emits a light beam on the basis of image data, and causes the emitted light beam to be reflected by a rotating polygon mirror and to pass through a scanning lens having an fθ characteristic, whereby the photosensitive member is scanned and exposed. The fθ characteristic of the scanning lens here refers to an optical characteristic that if the rotating polygon mirror is rotated at a constant angular velocity, a spot formed by the light beam moves on the surface of the photosensitive member at constant velocity. However, a scanning lens having the fθ characteristic has a large size, and this increases the size of the image forming apparatus. Therefore, not using a scanning lens itself or using a scanning lens that does not have the fθ characteristic has been considered.

Japanese Patent Application Laid-open No. S58-125064 discloses a configuration in which the clock frequency is changed to make the pixel width formed on the photosensitive member constant, even in a case where the spot of the light beam does not move on the surface of the photosensitive member at constant velocity. Japanese Patent Application Laid-open No. 2016-000511 discloses a technique to correct image density non-uniformity that is generated by an increase in light intensity per unit area on the surface of the photosensitive member. This light intensity increases as the scanning speed decreases.

Further, in recent years, demand to reduce the power consumption of the image forming apparatus has been increasing from the viewpoint of environmental protection, and a technique to minimize power consumption of the image forming apparatus, by decreasing the fixing temperature control value in accordance with the printing ratio of the image to be printed, is known (Japanese Patent Application Laid-open No. 2016-004231).

SUMMARY OF THE INVENTION

However, even if the correction in Japanese Patent Application Laid-open No. S58-125064 or Japanese Patent Application Laid-open No. 2016-000511 is performed, the laser spot shape becomes different between the center and the edges in the scanning direction, hence the layering state of toner, which forms dots on a photosensitive member, also becomes different accordingly. As a result, the layering state of the toner on paper also becomes different between the center and the edges of the paper, and in some cases the temperature required for fixing may become different between the center and the edges even if the intention is to form the uniform image. Depending on the developing conditions, this difference becomes great, which may make it difficult to determine the optimum fixing temperature control value for the image. Further, in the case of the method of determining the optimum fixing temperature control value based on the printing ratio of the image, as disclosed in Japanese Patent Application Laid-open No. 2016-004231, it is impossible to distinguish between an image that can be easily fixed (e.g. text) and an image that cannot be fixed so easily (e.g. solid patch), and it is also impossible to handle a situation where fixability is different depending on the position of the image.

With the foregoing in view, it is an object of the present invention to determine the optimum fixing temperature control value in accordance with the image in the forming apparatus having a configuration in which a spot of the light beam does not move on the surface of the photosensitive member at a constant velocity.

The present invention provides an image forming apparatus comprising:

a scanning unit that scans a surface of a photosensitive member with light and forms a latent image in accordance with image data;

a developing unit that supplies toner to the latent image and develop the latent image as a toner image;

a fixing unit that heats and fixes the toner image transferred to a recording material; and a control unit that controls a fixing temperature, which is a temperature at which the fixing unit heats the toner image, on the basis of the image data, wherein scanning velocity of the scanning unit changes depending on a position to be scanned, and the control unit analyzes a printing ratio by dividing the image data into a plurality of regions in a main scanning direction in which the scanning unit scans the surface of the photosensitive member with the light, and determines the fixing temperature on the basis of the position in the main scanning direction and the printing ratio for each of the plurality of regions.

According to the present invention, an optimum fixing temperature control value in accordance with the image can be determined in the image forming apparatus having a configuration in which a spot of the light beam does not move on the surface of the photosensitive member at a constant velocity.

Further features of the present invention will become apparent from the following description of exemplary embodiments with reference to the attached drawings.

BRIEF DESCRIPTION OF THE DRAWINGS

FIG. 13A to FIG. 13E are images used for fixability evaluation in the embodiments and comparative examples.

DESCRIPTION OF THE EMBODIMENTS

Embodiments of the present invention will be described in detail with reference to the drawings. Dimensions, materials and shapes of the components and relative positions thereof described in the embodiments should be changed appropriately depending on the configuration of the device, to which the invention is applied, and various conditions, and are not intended to limit the scope of the present invention to the following embodiments.

Example 1

Apparatus Configuration

Figure 1:
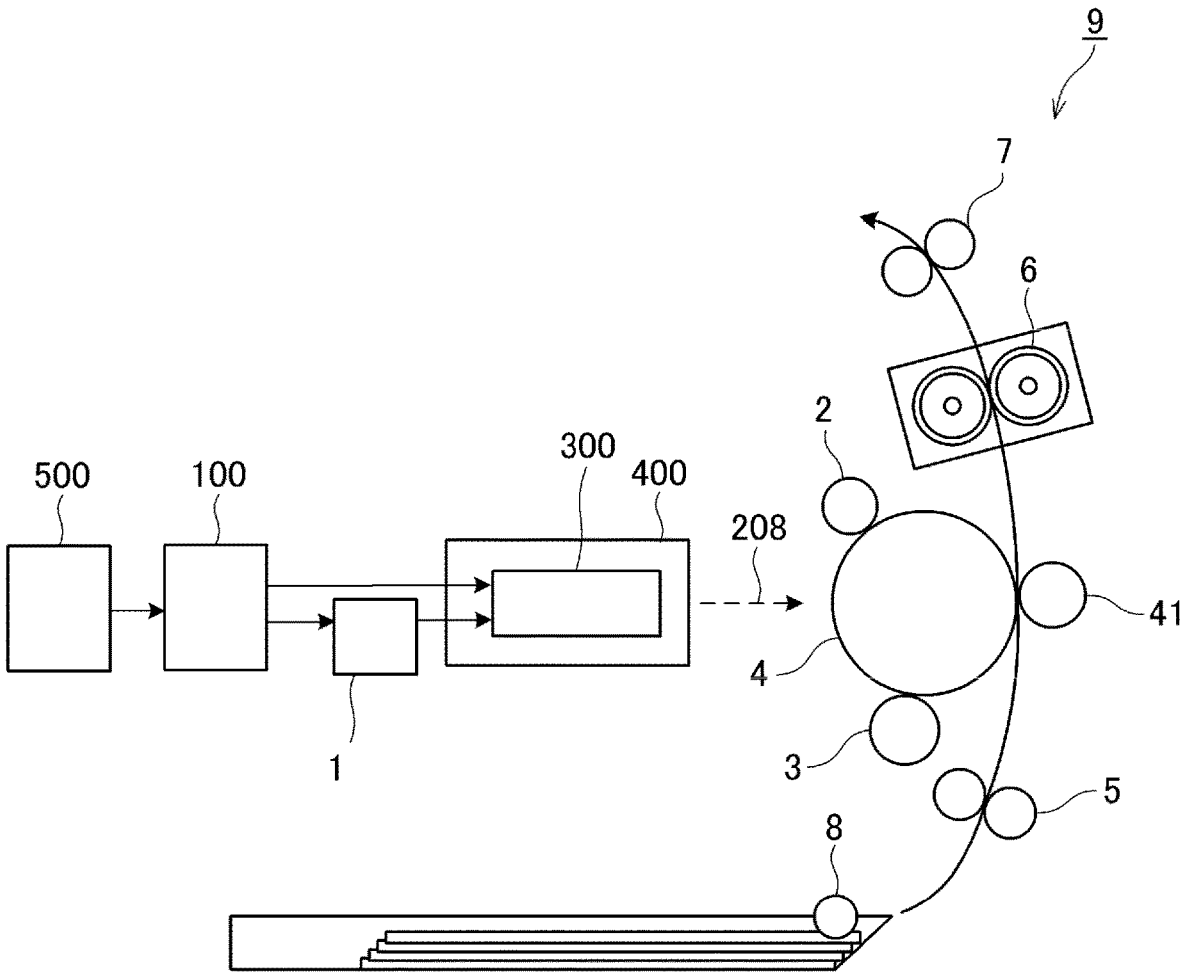
FIG. 1 is a cross-sectional view depicting a configuration of an image forming apparatus of Example 1.

FIG. 1 is a schematic diagram depicting a configuration of an image forming apparatus 9 according to Example 1. The image forming apparatus 9 of Example 1 is assumed to be an A4 monochrome laser beam printer. A laser drive unit 300 of an optical scanner 400 ("scanning Unit" in Claims) emits a light beam 208 (light) based on image data outputted from an image signal generation unit 100. A photosensitive member 4, which is charged by a charging unit 2 (e.g. conductive rubber roller), is scanned and exposed with this light beam 208, whereby a latent image is formed on the surface of the photosensitive member 4. A developing unit 3 ("developing unit") develops this latent image with toner, and forms a toner image.

A recording medium fed from a paper feeding unit 8 is transported by a roller 5 to a nip region between the photosensitive member 4 and a transfer roller 41. The transfer roller 41 transfers the toner image formed on the photosensitive member 4 onto this recording medium. After the untransferred toner remaining on the photosensitive member 4 (transfer residual toner) is cleaned by a cleaning unit (not illustrated), the photosensitive member 4 is used for the next image forming. The recording medium on which the toner image is transferred, on the other hand, is transported to a fixing unit 6 ("fixing unit"). The fixing unit 6 heats and presses the recording medium, and fixes the toner image to the recording medium. The recording medium on which the toner image is fixed is discharged out of the image forming apparatus 9 by a discharging roller 7.

Optical Scanner

Figure 2A:
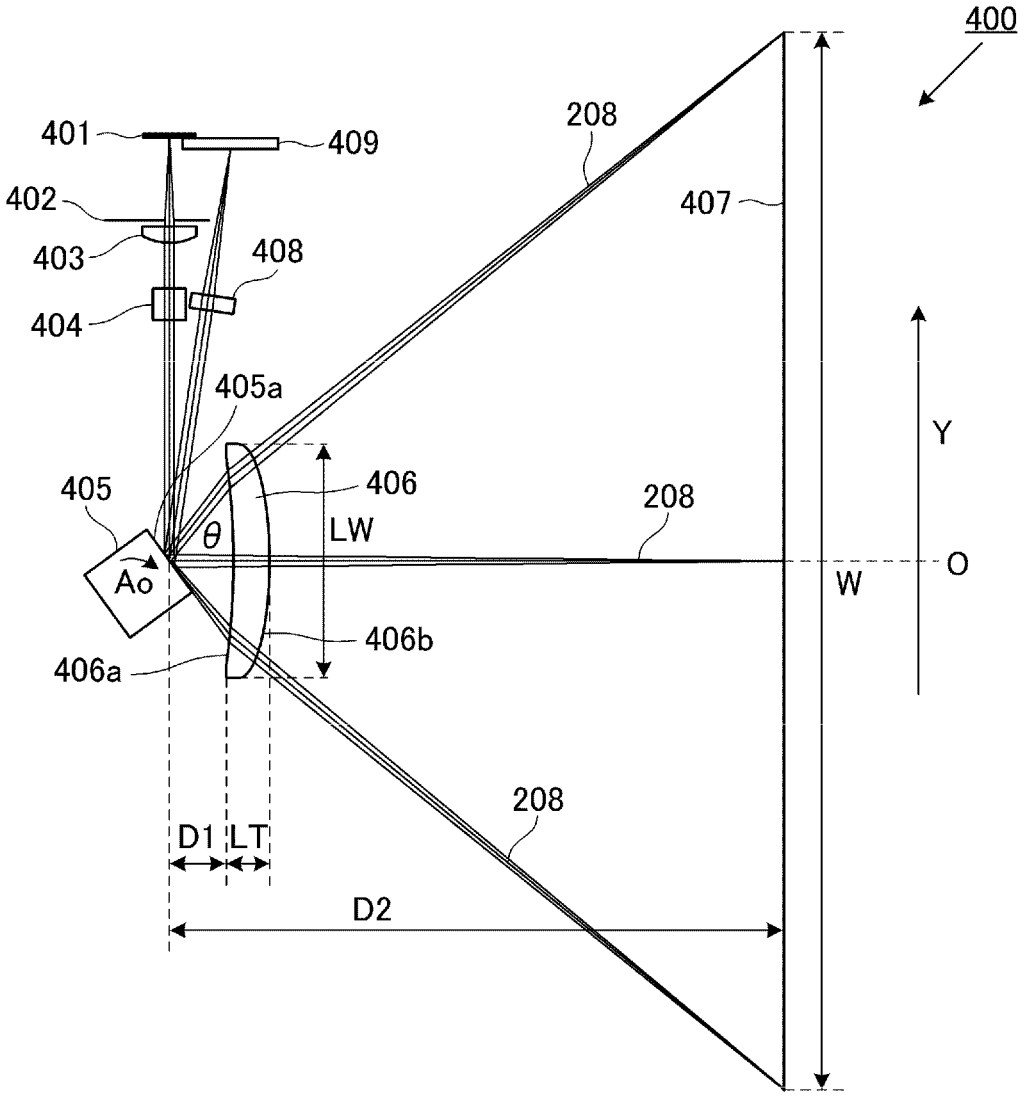
FIG. 2A and FIG. 2B are diagrams depicting a configuration of an optical scanner of Example 1.
Figure 2B:
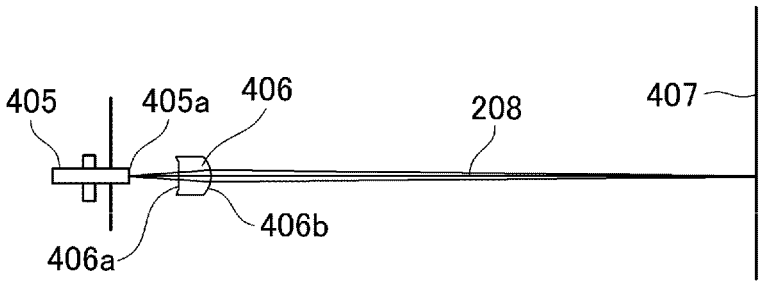

FIG. 2A and FIG. 2B are diagrams depicting the configuration of the optical scanner 400 according to Example 1, where FIG. 2A is a cross-sectional view in a main scanning direction, and FIG. 2B is a cross-sectional view thereof in a sub-scanning direction. The main scanning direction is a direction that is parallel with the surface of the photosensitive member 4, and is perpendicular to the moving direction on the surface of the photosensitive member 4. The sub-scanning direction is the moving direction on the surface of the photosensitive member 4. In Example 1, the main scanning direction is a direction perpendicular to the direction of transporting the recording material, and the sub-scanning direction is the direction of transporting the recording material.

In FIG. 2A, a light beam 208 emitted from a light source 401 is shaped by an aperture 402 to be elliptic, and enters a coupling lens 403. The light beam 208 which passed through the coupling lens 403 is converted into approximately parallel light, and enters an anamorphic lens 404. The approximately parallel light includes weak converging light and weak diverging light. The anamorphic lens 404 has a positive refractive power in the cross-section in the main scanning direction, and converts the entered beam into converging light in the cross-section in the main scanning direction. The anamorphic lens 404 also collects the beams in the vicinity of a reflection surface 405*a* of a deflector (polygon mirror) 405 in the cross-section in the sub-scanning direction, and forms a long line image in the main scanning direction.

The beam that passed through the anamorphic lens 404 is reflected by the reflection surface 405*a* of the deflector 405. The light beam 208 reflected by the reflection surface 405*a* transmits through an image forming lens 406, forms an image on the surface of the photosensitive member 4, and forms a predetermined spot-shaped image (hereafter referred to as "spot"). By rotating the deflector 405 using a drive unit (not illustrated) in the arrow Ao direction at a constant angular velocity, the spot moves in the main scanning direction on a scanned surface 407 of the photosensitive member 4, and forms an electrostatic latent image on the scanned surface 407. FIG. 2A indicates three locations that are scanned with the light beam 208 in the main scanning direction.

A beam detect sensor 409 (hereafter referred to as "BD sensor 409") and a beam detect lens 408 (hereafter referred to as "BD lens 408") constitute an optical system for synchronization, which determines a timing to write the electrostatic latent image on the scanned surface 407. The light beam 208, which passed through the BD lens 408, enters the BD sensor 409, which includes a photodiode, and is detected. Based on the timing when the BD sensor 409 detected the light beam 208, the write timing is controlled. The light source 401 of Example 1 includes one light-emitting unit, but the light source 401 may include a plurality of light-emitting units of which emission can be independently controlled.

As illustrated in FIG. 2A and FIG. 2B, the image forming lens 406 includes two optical surfaces (lens surfaces), that is, an incident surface 406*a* and an emission surface 406*b*. The image forming lens 406 is configured such that the scanned surface 407 is scanned with the beam deflected by the reflection surface 405*a* at a predetermined scanning characteristic in the cross-section in the main scanning direction. The image forming lens 406 is also configured such that the spot of the light beam 208 on the scanned surface 407 is formed to a desired shape.

The image forming lens 406 of Example 1 does not have the fθ characteristic. In other words, the image forming lens 406 does not have a scanning characteristic that moves the spot of the beam passing through the image forming lens 406 on the scanned surface 407 at constant velocity when the deflector 405 is rotating at a constant angular velocity. By using the image forming lens 406 not having the fθ characteristic, the image forming lens 406 can be disposed close to the deflector 405 (can be disposed at a location of which distance D1 is short). Further, in the case of the image forming lens 406 not having the fθ characteristic, the length in the main scanning direction (width LW) and in the optical axis direction (thickness LT) can be shorter than an image forming lens having the fθ characteristic. Thereby a case (not illustrated) of the optical scanner 400 can be downsized.

Furthermore, in the case of a lenses having the fθ characteristic, the shape of the incident surface and the emission surface may sharply change when viewed in the cross-section in the main scanning direction, and if there is such restriction on the shapes, a good image forming performance may not be implemented. In the case of the image forming lens 406 not having the fθ characteristic, on the other hand, the shapes of the incident surface and the emission surface do not sharply change very much when viewed in the cross-section in the main scanning direction, hence a good image forming performance can be implemented.

The scanning characteristic of the image forming lens 406 of Example 1 is given by the following Expression (1).

[Math 1]

$$Y = \frac{K}{B}\tan B\theta \tag{1}$$

In Expression (1), θ is the scanning angle (scanning angle of view) by the deflector 405, Y [mm] is a converging position (image height) of the beam on the scanned surface 407 in the main scanning direction, K [mm] is an image forming coefficient at an on-axis image height, and B is a coefficient that determines the scanning characteristic (scanning characteristic coefficient) of the image forming lens 406.

In Example 1, the on-axis image height indicates the image height on the optical axis (Y=0=Ymin), and corresponds to the scanning angle θ=0. The off-axis image height indicates the image height outside the center optical axis (scanning angle θ=0) (Y≠0), and corresponds to the scanning angle θ≠0. Further, the maximum off-axis image height indicates the image height when the scanning angle θ is the maximum (maximum scanning angle of view) (Y=+Ymax, −Ymax).

The scanning width W, which is a width in the main scanning direction, of the predetermined region (scanning region) where the latent image can be formed on the scanned surface 407, is given by W=|+Ymax|+|−Ymax|. The image height at the center of the predetermined region is the on-axis image height, and the image height at the edges of the predetermined region is the maximum off-axis image height.

The image forming coefficient K here is a coefficient corresponding to f of the scanning characteristic (fθ characteristic) Y=fθ, in a case where a parallel light enters the image forming lens 406. In other words, in a case where a beam other than the parallel light enters the image forming lens 406, the image forming coefficient K is used to make the converging position Y and the scanning angle θ to have a proportional relationship, just like the case of the fθ characteristic.

In addition, regarding the scanning characteristic coefficient, Expression (1) becomes Y=Kθ when B=0, which corresponds the scanning characteristic Y=fθ of the image forming lens used for the conventional optical scanner. Further, Expression (1) becomes Y=K tan θ when B=1, which corresponds to the projection characteristic Y=f tan θ of the lens used for an imaging apparatus (camera), or the like. In other words, by setting the scanning characteristic coefficient B in Expression (1) in the 0≤B ≤1 range, the scanning characteristic between the projection characteristic Y=f tan θ and the fθ characteristic Y=fθ can be acquired.

When Expression (1) is differentiated by the scanning angle θ, the scanning velocity of the beam on the scanned surface 407, with respect to the scanning angle θ, can be acquired by the following Expression (2).

[Math 2]

$$\frac{dY}{d\theta} = \frac{K}{\cos^2 B\theta} \tag{2}$$

Expression (2) can be further transformed to the following Expression (3).

[Math 3]

$$\frac{\frac{dy}{d\theta}}{K} - 1 = \frac{1}{\cos^2 B\theta} - 1 = \tan^2 B\theta \tag{3}$$

Expression (3) expresses partial magnification, that is the deviation of the scanning velocity of each off-axis image height with respect to the scanning velocity of the on-axis image height. In the optical scanner 400 of Example 1, the scanning velocity of the beam is different between the on-axis image height and the off-axis image height, unless B=0.

Figure 3:
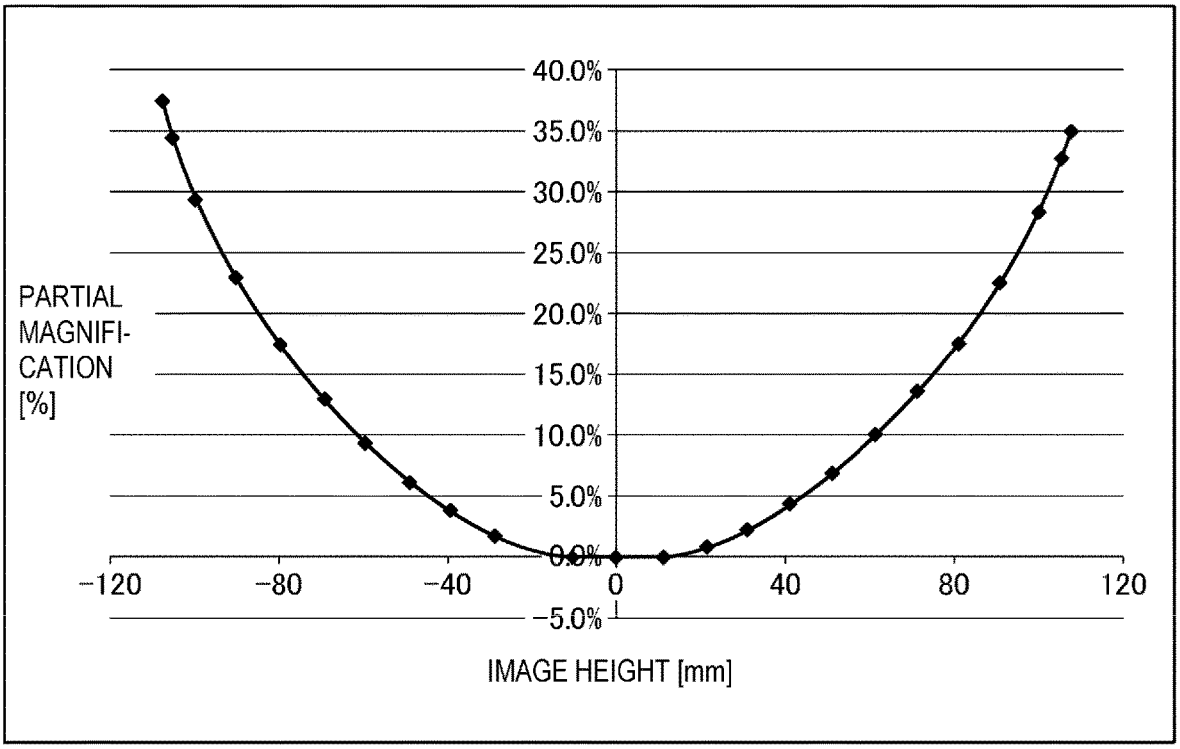
FIG. 3 is a graph indicating a relationship between an image height and partial magnification of the optical scanner of Example 1.

FIG. 3 indicates a relationship between an image height and partial magnification when the scanning position on the scanned surface 407 of Example 1 is curve-fitted with the characteristic of Y=Kθ. In Example 1, the scanning characteristic indicated in Expression (1) is provided to the image forming lens 406, hence, as indicated in FIG. 3, the scanning velocity gradually increases, and the partial magnification increases in the direction from the on-axis image height to the off-axis image height. The 30% partial magnification indicates that the irradiation length on the scanned surface 407 in the main scanning direction becomes 1.3 times when the light is emitted for a unit time. In the case of FIG. 3, the scanning velocity is the lowest at the on-axis image height, and becomes faster as the absolute value of the image height increases. Therefore, if the pixel width in the main scanning direction is determined based on a predetermined time interval, which is determined by the clock cycle, the pixel density becomes different between the on-axis image height and the off-axis image height. As a consequence, partial magnification correction is performed in this embodiment. Specifically, clock correction is performed by adjusting the clock frequency in accordance with the image height, so that the pixel width becomes approximately constant regardless the image height.

In Example 1, the distance D2 from a point on the deflector where the laser is reflected to the scanned surface is 130 mm, W is 216 mm, and the partial magnification (hereafter referred to as Dmax) at the maximum off-axis is 30%. In this case, B=0.734. The maximum value of the scanning angle θ is 40°.

Further, the time required for scanning the unit length when the image height on the scanned surface 407 is near the maximum off-axis image height is shorter than the time required for scanning the unit length when the image height is near the on-axis image height. This means that in the case where the emission brightness of the light source 401 is constant as in the case of FIG. 2A and FIG. 2B, the total exposure amount (Ee) per unit length, when the image height is near the maximum off-axis image height, becomes lower than the total exposure amount (Ec) per unit length when the image height is near the on-axis image height. The ratio Er between Ec and Ee is Er=Ec/Ee=130%. This means that the light quantity near the on-axis image height is 30% more than the light quantity near the maximum off-axis image height. The method of correcting the partial magnification is not limited to the clock correction, but a conventional pixel segment insertion/extraction correction, for example, may be used.

Brightness Correction

Brightness correction will be described next. Because of the partial magnification correction, the length of one pixel decreases as the absolute value of the image height Y is larger, which means that the total exposure amount (integrated light quantity) of the light from the light source 401 to one pixel decreases as the absolute value of the image height Y increases. This is why the brightness correction is performed. In the brightness correction, the brightness of the light source 401 is corrected so that the total exposure amount (integrated light quantity) of light to one pixel becomes constant regardless the image height. The density of each pixel is corrected to be constant by the brightness correction.

Figure 4:
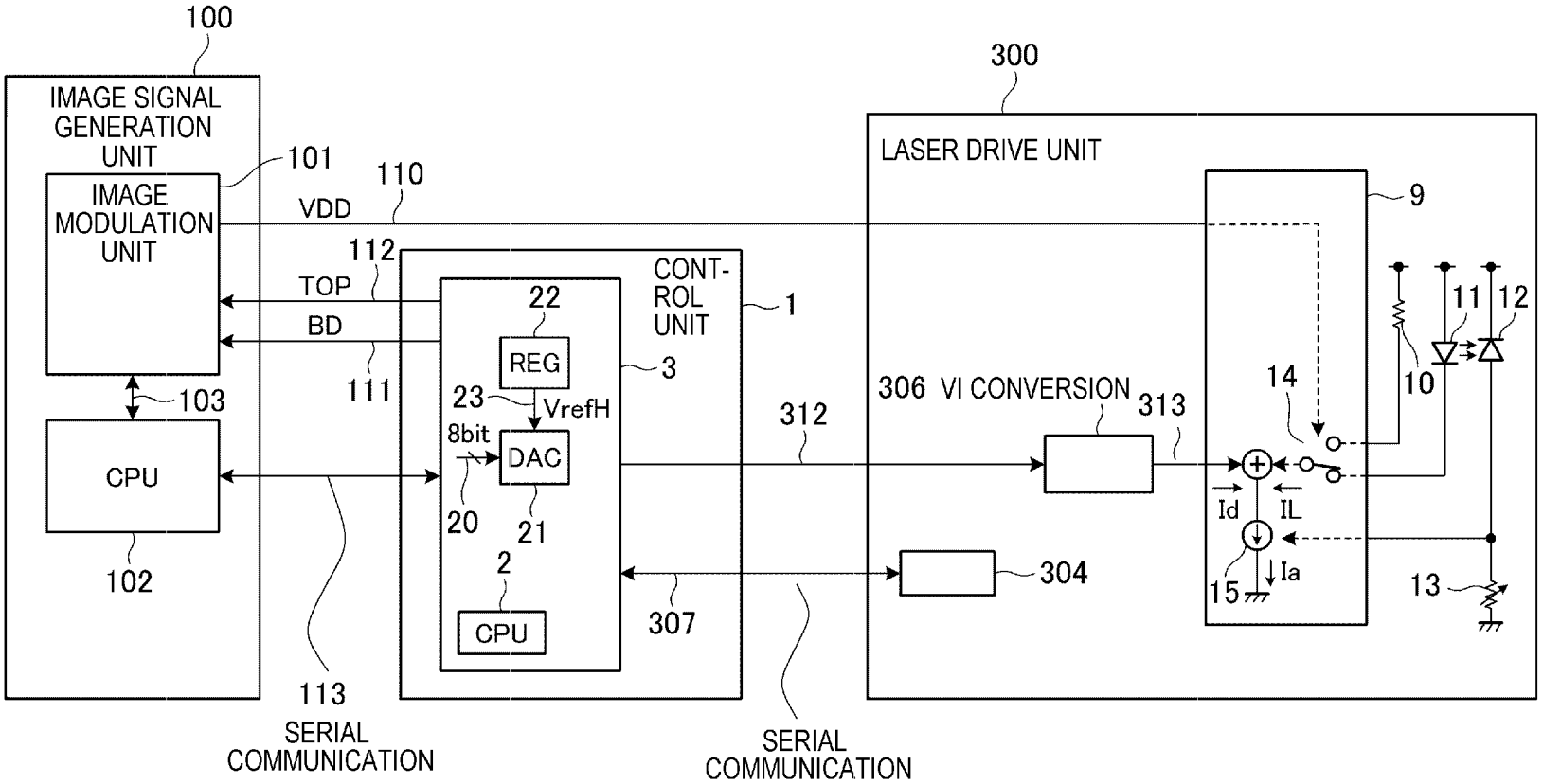
FIG. 4 is a diagram of depicting the brightness correction control of the optical scanner of Example 1.

FIG. 4 indicates a state where the control unit 1 ("control unit") included in the image forming apparatus 9 of Example 1 performs the brightness correction control, along with the image signal generation unit 100 and the laser drive unit 300. The control unit 1 has an IC 3 which includes the CPU core 2, an 8-bit DA convertor 21, and a regulator 22, and the control unit 1 and the laser drive unit 300 constitute a brightness correction unit. The laser drive unit 300 includes a memory 304, a VI conversion circuit 306 that converts voltage into electric current, and a laser driver IC 9, and supplies the drive current to a light emission unit 11, which is a laser diode of the light source 401. The memory 304 stores the partial magnification characteristic information, and the information on the correction current that is supplied to the light emission unit 11. The partial magnification characteristic information is partial magnification information which corresponds to a plurality of image heights with respect to the main scanning direction. Instead of the partial magnification information, characteristic information on the scanning velocity on the scanned surface may be used.

The operation of the laser drive unit 300 will be described next. Based on the information on the correction current to the light emission unit 11 stored in the memory 304, the IC 3 adjusts the voltage 23 outputted from the regulator 22, and outputs the adjusted voltage. The voltage 23 becomes the reference voltage of the DA convertor 21. Then the IC 3 sets the input data 20 of the DA convertor 21, and outputs brightness correction analog voltage 312 which is adjusted in the main scanning, synchronizing with the BD signal 111. Then in the VI conversion circuit 306 in the subsequent stage, the brightness correction analog voltage 312 is converted into the electric current value Id 313, and is outputted to the laser driver IC 9. In Example 1, the IC 3 mounted on the control unit 1 outputs the brightness correction analog voltage 312, but a DA convertor may be mounted on the laser drive unit 300, so as to generate the brightness correction analog voltage 312 in the vicinity of the laser driver IC 9.

The laser driver IC 9 switches whether the electric current IL is supplied to the light emission unit 11 or to a dummy resistor 10, in accordance with the VDD signal 110, so as to control ON/OFF of the light emission of the light source 401. A laser electric current value IL (third electric current) supplied to the light emission unit 11 is the electric current value determined by subtracting an electric current Id (second electric current), which is outputted from the VI conversion circuit 306, from an electric current Ia (first electric current), which is set by a constant electric current circuit 15. The electric current Ia supplied to the constant electric current circuit 15 is automatically adjusted by a circuit inside the laser driver IC 9 performing feedback control, so that the brightness detected by the photodetector 12, which is disposed in the light source 401 for monitoring the light quantity of the light emission unit 11, becomes the desired brightness Papc1. This automatic adjustment is an auto power control (APC). The automatic adjustment of the brightness of the light emission unit 11 is performed while the light emission unit 11 is emitting light to detect a BD signal outside a print region for each main scanning with the laser emission amount 316. The method of setting the electric current Id outputted by the VI conversion circuit 306 will be described later. The value of the variable resistor 13 is adjusted in advance during factory assembly, so that a desired voltage is inputted to the laser driver IC 9 while the light emission unit 11 is emitting light at a predetermined brightness.

As described above, an amount of electric current, determined by subtracting the electric current Id outputted by the VI conversion circuit 306 from the electric current Ia required for emitting light at a desired brightness, is supplied to the light emission unit 11 as the laser drive current IL. Because of this configuration, the laser drive current IL exceeding Ia does not flow. The VI conversion circuit 306 constitutes a part of the brightness correction member.

The brightness correction is performed by subtracting the electric current Id from the electric current Ia, which is automatically adjusted to emit light at the desired brightness. As mentioned above, the scanning velocity increases as the absolute value of the image height Y increases. Further, as the absolute value of the image height Y increases, the total exposure amount (integrated light quantity) to one pixel decreases. Therefore, the brightness correction is performed such that the brightness increases as the absolute value of the image height Y increases. Specifically, setting is adjusted so that the electric current value Id decreases as the absolute value of the image height Y increases, whereby the electric current IL increases as the absolute value of the image height Y increases. In this way, the total exposure amount to one pixel can be constant regardless the image height.

The method of correcting the density by correcting the brightness using the electric circuits of Example 1 was described. However, it is also possible to make the total exposure amount constant by image data correction, in which image processing, to decrease the density of the center portion of the original image to be printed, is performed.

Laser Spot Shape

Figure 5:
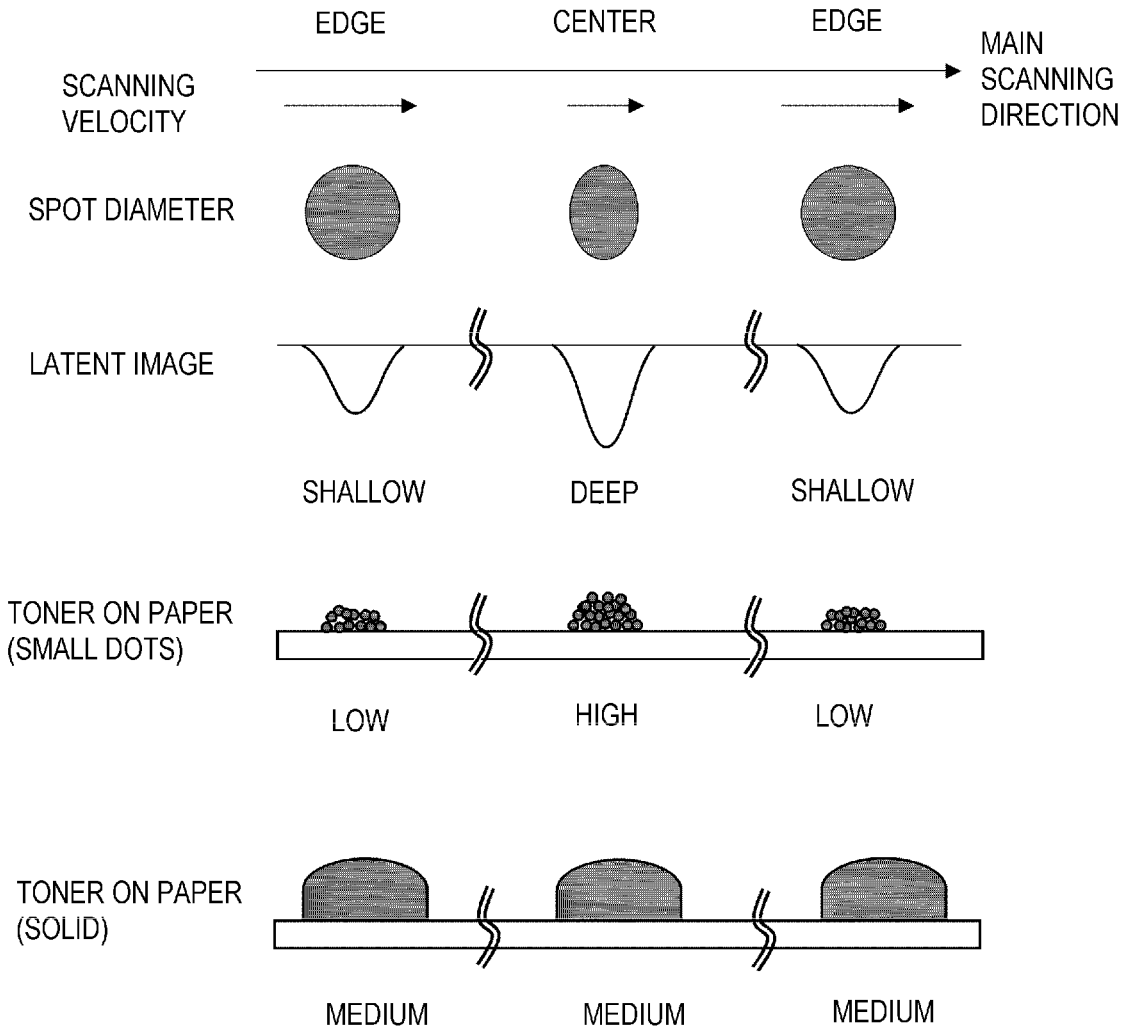
FIG. 5 is a diagram depicting a spot shape, a latent image and a toner layered state on paper of the optical scanner of Example 1.

The partial magnification correction and the brightness correction were described above. The spot shape of the laser for each dot, on the other hand, changes with respect to the main scanning direction by the changes of the scanning velocity of the laser in accordance with the image height. FIG. 5 is a diagram depicting a spot shape (spot diameter), a latent image and a toner layered state on paper of the optical scanner 400, at each position and scanning velocity in the main scanning direction. As illustrated in FIG. 5, the spot diameter is large in the main scanning direction at the maximum off-axis image height positions on the edges where scanning velocity is high, and the spot diameter is small in the main scanning direction at the image height center of the center portion where the scanning velocity is low.

Layer Configuration of Photosensitive Member

The photosensitive member 4 used for the image forming apparatus of the present invention is a layered-type photosensitive member, where an electric charge generation layer and an electric charge transporting layer are sequentially formed on a conductive support member having an undercoat layer.

Surface Potential of Photosensitive Member

In Example 1, the reversal developing method, in which the charging polarity of the toner and the charging polarity of the photosensitive drum both have negative polarity, is used. The charging system used here is a DC charging system, in which a conductive rubber roller (charging roller) is contacted with the photosensitive member 4, and DC voltage is applied while the conductive rubber roller is rotated by the rotation of the photosensitive member 4. While forming the image, a −950V DC voltage is applied to the charging roller, and the surface potential of the photosensitive drum 4 is uniformly charged to −480V by the charging roller, then the potential of the solid exposure unit is decreased to about −100V by the optical scanner 400, whereby the latent image is formed.

Toner Layered State on Photosensitive Member

FIG. 5 also indicates the toner layered states on the photosensitive member 4 in Example 1, in a case of a small dot and in a case of a solid image. In the case of a small dot, that is, in a pattern of one dot at 600 dpi, the latent image changes due to the difference of the spot shape depending on the position in the main scanning direction. In other words, at the maximum off-axis image height position, a spot diameter is large and the light quantity per unit area is small, hence the latent image becomes relatively shallow, and in the vicinity of the center of the image height, a spot diameter is small and the light quantity per unit area is large, hence the latent image can be formed relatively deep. As a result, in the toner layered state on the photosensitive member 4, the layer becomes low at the maximum off-axis image height position, and high in the vicinity of the center of the image height. According to the result of intensive studies by the present inventor, if the size of the image is three dots or less, the toner layered state changes depending on the image height position due to the difference in this spot shape.

In the case of a four dot or larger solid image, on the other hand, spots overlap in more portions, and the influence of the difference of spot diameters decreases. As a result, the latent image is uniformly formed regardless the image height position, hence the toner layered state also becomes uniform.

This toner layered state is related to easy of fixing. As the toner layer is higher, more heat is needed to melt the toner, hence fixing is more difficult, and a high fixing temperature control value is required. If the toner layer is low, hence less heat is needed to melt the toner, and fixing can be performed even with a low fixing temperature control value.

Developing System

For the developing apparatus of Example 1, a magnetic single-component jumping developing system is used. A developing sleeve, used as a rotatable toner bearing member, faces the photosensitive member, and by the rotation of the developing sleeve, magnetic toner regulated by a metal blade is coated. The magnetic toner is held on the developing sleeve by a magnet inside the developing sleeve. A 350 μm gap is created between the surface of the photosensitive member and the developing sleeve. For the developing bias, a rectangular AC bias is superimposed on a DC bias, and toner on the developing sleeve rises to the surface of the photosensitive member in a cloud shape, and develops the latent image on the photosensitive member. If the coated toner amount on the developing sleeve is low, the toner is constrained on the developing sleeve by magnetic force and electrostatic force and does not rise in the developing nip, hence a toner image having sufficient density cannot be formed on the photosensitive member. As a result, the toner layer on the developing sleeve becomes thicker than the toner layer of the solid portion on the photosensitive member. The developing potential is an average value of the AC bias in one cycle, and is −300V in Example 1.

The magnetic single-component jumping developing system has an advantage over the non-magnetic contact developing system and the two-component developing system, because it is easy to manufacture a small sized developing apparatus at low cost. On the other hand, in the case of the jumping developing system, toner laid on the developing sleeve is not developed 100%, hence if the latent image of the solid portion of the photosensitive member changes, the toner amount layered on the solid portion also easily changes. In the case of the contact developing system, however, toner on the developing roller is developed virtually 100% for the solid portion, hence the toner amount formed on the solid portion of the photosensitive member does not exceed a value determined by multiplying the toner amount on the developing roller by the peripheral velocity ratio of the developing roller and the photosensitive member. Therefore, in the contact developing system, the toner amount on the photosensitive member tends not to change very much when the latent image on the photosensitive member changes.

Figure 6A:
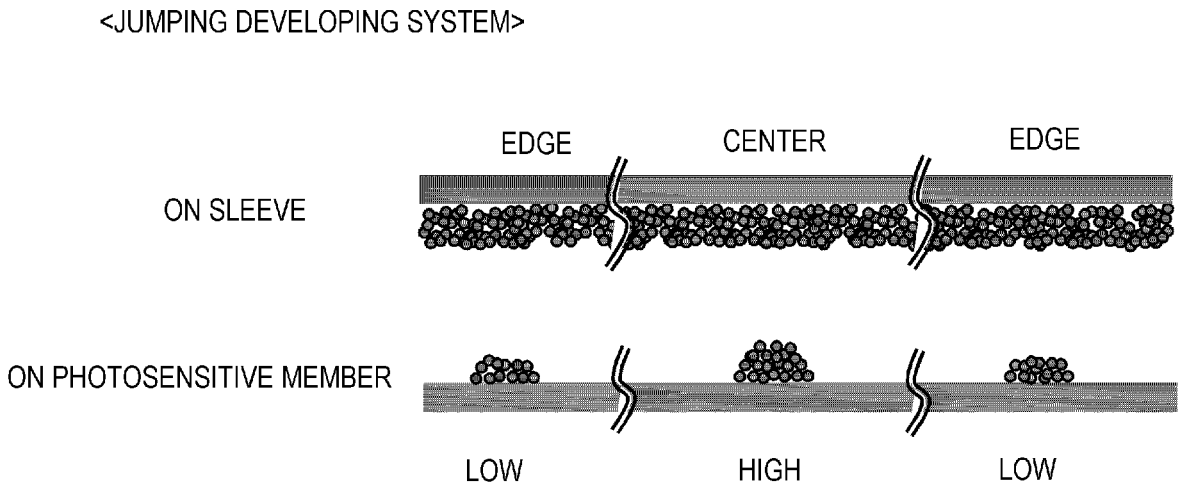
FIG. 6A and FIG. 6B are diagrams depicting a toner layered state according to the developing method of Example 1, and that of Modification 1.
Figure 6B:
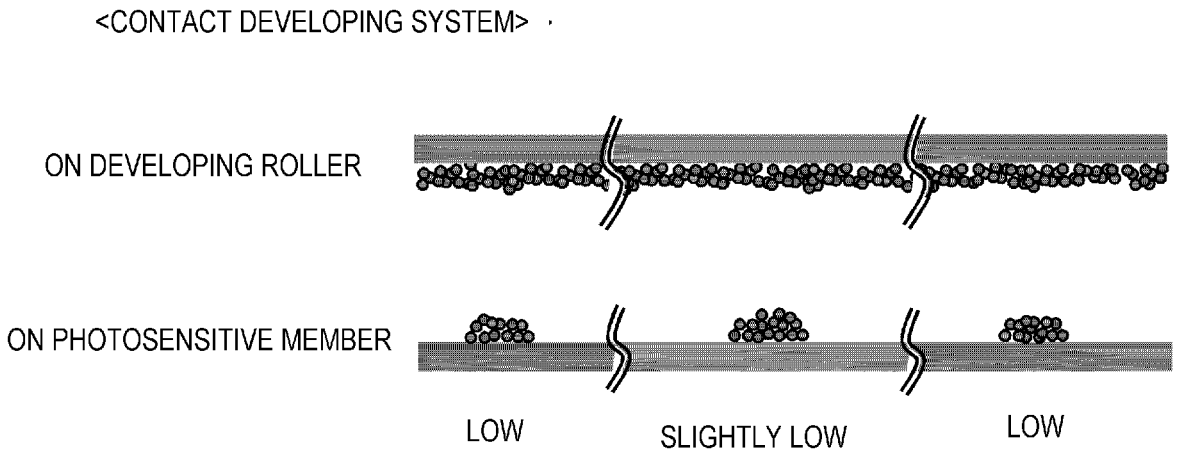

FIG. 6A and FIG. 6B indicate a comparison of the toner layered states on the developing sleeve (roller) and on the photosensitive member between the jumping developing system and the contact developing system. Even in the case of the contact developing system, the toner laid-on level of a small dot is different between the center and the edges, but in the case of the jumping developing system, the difference of the toner laid-on level of a small dot between the center and the edges is larger. In Example 1, magnetic toner, of which average particle diameter is 8 μm, is used.

Fixing Apparatus

A film heating type thermal fixing apparatus 6 of the present embodiment will be described with reference to FIG. 7. The thermal fixing apparatus 6 is constituted of a film unit 10 (heating apparatus) and a pressure roller 20. The film unit 10 is constitute of: a fixing film (heat resistant film) 13, which is a rotating member for heating (heat transfer member); a heater 11 (heating member); and a holder 12 (heater holding member). The heater 11 is installed on the inner side of the fixing film 13. In the thermal fixing apparatus 6, a pressure roller 20 (rotating member for pressing) is also disposed as a counter member facing the film unit 10. In the thermal fixing apparatus 6 configured like this, a recording material P, on which a toner image t is formed, is held and transported by a fixing nip portion (press-contact nip portion, nip portion) formed between the fixing film 13 and the pressure roller 20. Thereby the toner image t, which is transported together with the fixing film 13, is fixed to the recording material P. The thermal fixing apparatus 6 is an example of the fixing unit. The fixing film 13 is an example of the fixing member. The pressure roller 20 is an example of the pressing member.

Figure 7:
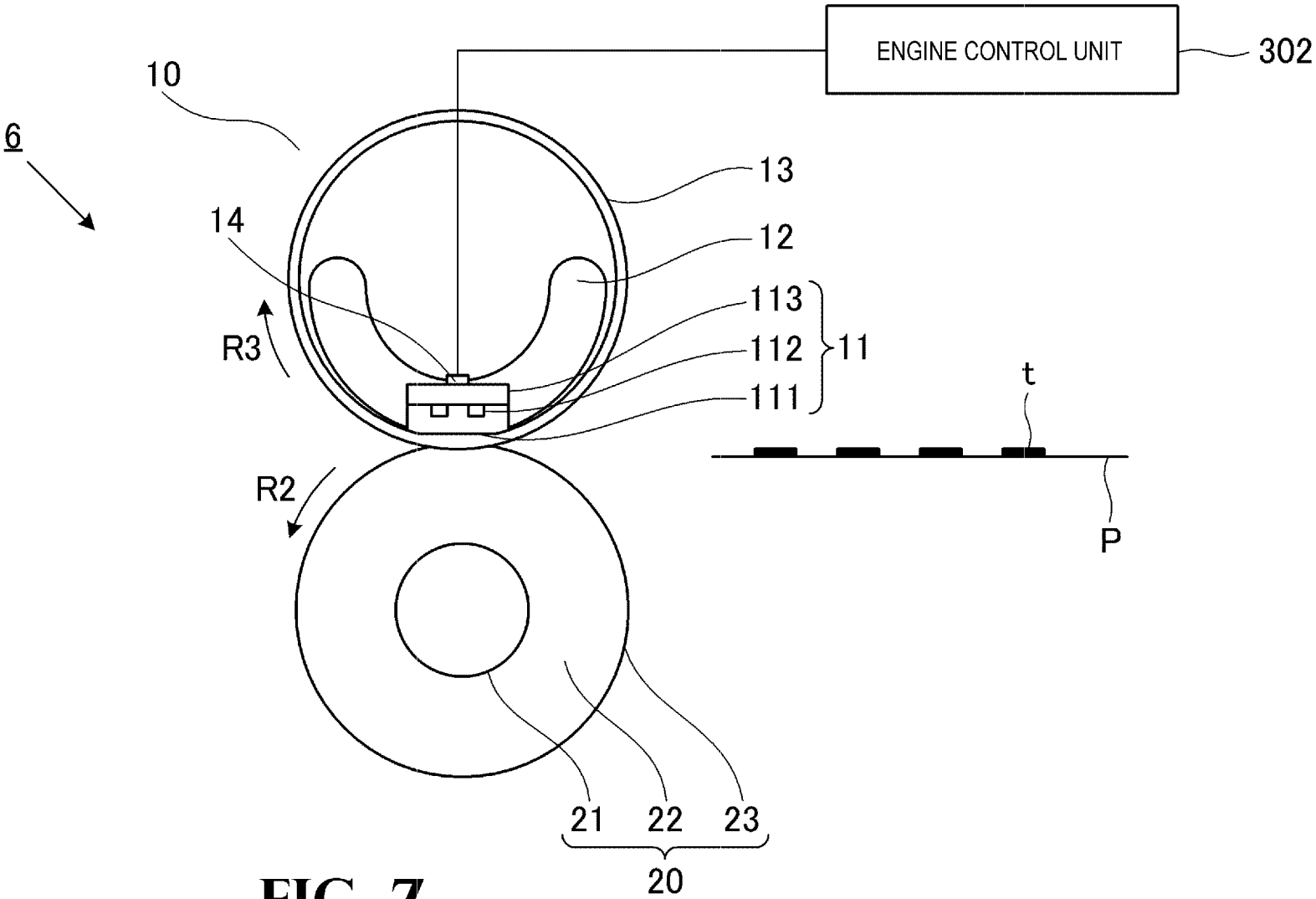
FIG. 7 is a cross-sectional view depicting a configuration of a fixing apparatus of Example 1.

As illustrated in FIG. 7, in the heater 11, a thermistor 14 (temperature detecting member) is disposed to contact with the opposite side surface of the surface where the fixing film 13 slides. An engine control unit 302 controls the electric current of the heater 11 based on the detected temperature of the thermistor 14, so that the temperature of the heater 11 maintains a desired temperature. For example, the temperature of the heater 11 is adjusted by the fixing control unit 320 controlling the electric current that is supplied to the heater 11 in accordance with the signal of the thermistor 14.

Fixing Film

The fixing film 13 is a composite layer film generated by coating or covering a tube of a release layer (e.g. PFA, PTFE, FEP) on a surface of thin metal element tube (e.g. SUS) directly or via a primer layer. Instead of a metal element tube, a base layer, formed by molding a mixture of a heat resistant resin (e.g. polyimide) and heat-conductive filler (e.g. graphite) into a tube shape, may be used. For the fixing film 13 of Example 1, a film generated by coating PFA on the polyimide base layer is used. The total film thickness of the fixing film 13 is 80 μm, and the outer peripheral length of the fixing film 13 is 56 mm. The fixing film 13 rotates while sliding with the heater 11 and the holder 12 which are disposed on the inner side of the fixing film 13, hence frictional resistance of the fixing film 13 with the heater 11 and the holder 12 must be minimized. Therefore, a small amount of lubricant (e.g. heat resistant grease) is coated on the surfaces of the heater 11 and the holder 12. Thereby the fixing film 13 can rotate smoothly.

Pressure Roller

The pressure roller 20 illustrated in FIG. 7 includes a core metal 21 made of iron or the like, an elastic layer 22 and a release layer 23. The elastic layer 22 is formed by foaming an insulating heat resistant rubber, such as silicon rubber and fluoro rubber, on the core metal 21, and an RTV silicon rubber is coated on the elastic layer 22, to be an adhesive layer primer-processed to have adhesive properties. The release layer 23 covers the elastic layer 22 via the adhesive layer as a tube in which such a conductive agent as carbon is disposed in PFA, PTFE, FEP or the like, or is coated on the elastic layer 22, via the adhesive layer. In Example 1, the outer diameter of the pressure roller 20 is 20 mm, and the hardness of the pressure roller 20 is 48° (Asker-C 600 g weighted). The pressure roller 20 is pressed at 15 kg·f by a pressing member (not illustrated) from both edges in the longitudinal direction, so as to form a nip portion required for thermal fixing. Furthermore, the pressure roller 20 is rotary-driven in the arrow R2 direction (counterclockwise) in FIG. 7 by a rotary driving force (not illustrated) from an edge in the longitudinal direction via the core metal 21. Thereby the fixing film 13 is rotated outside the holder 12 in the arrow R3 direction (clockwise) in FIG. 7.

Heater

As illustrated in FIG. 7, the heater 11 is installed on the inner side of the fixing film 13. The heater 11 includes a substrate (insulating substrate) 113 made of ceramic (alumina or aluminum nitride), and a resistance heating layer (heating elements) 112 which is formed on the substrate 113. For the insulation and abrasion resistance of the resistance heating layer 112, the resistance heating layer 112 is covered with a thin overcoat glass 111, and the overcoat glass 111 contacts the inner peripheral surface of the fixing film 13. The overcoat glass 111 excels in voltage resistance and abrasion resistance, and is structured to slide with the fixing film 13. In the case of the overcoat glass 111 of Example 1, the thermal conductivity is 1.0 W/m·K, the withstand voltage characteristic is at least 2.5 kV, and the film thickness is 70 μm. Alumina is used for the substrate 113 of the heater 11 of Example 1. The dimensions of the substrate 113 are: a 6.0 mm width, a 260.0 mm length, and a 1.00 mm thickness, and the thermal expansion coefficient of the substrate 113 is 7.6×10−6/° C. The resistance heating layer 112 of Example 1 is made of a silver palladium alloy, and the total resistance value of the resistance heating layer 112 is 20Ω, and the temperature dependence of the resistivity is 700 ppm/° C. The heater 11 is an example of the fixing unit.

Holder

The holder 12 is a heat resistant stay holder that holds the heater 11 and prevents heat from dissipating to the rear side of the nip portion, and is made of liquid crystal polymer, phenol resin, PPS, PEEK or the like. The fixing film 13 is externally fitted into the holder 12 to allow some play, so that the fixing film 13 can be freely rotated. In Example 1, the holder 12 is made of liquid crystal polymer having a 260° C. heat resistance.

Image Processing Unit

Figure 8:
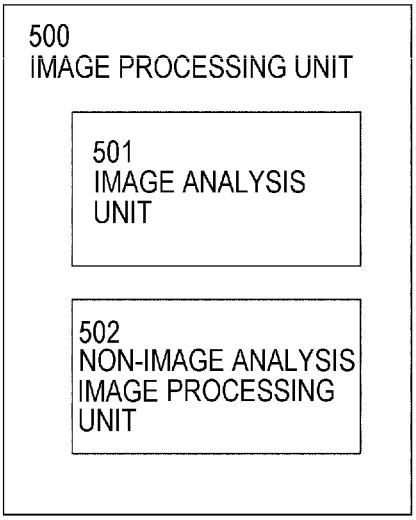
FIG. 8 is a diagram depicting an image processing unit of Example 1.

FIG. 8 is a functional configuration portion of the image processing unit 500. The image processing unit 500 is constituted of an image analysis unit 501 ("image analysis unit") and a non-image analysis image processing unit 502. The image analysis unit 501 calculates the temperature control value required for an image to be printed, or a fixing temperature correlation value that is correlated to the required temperature control value, as described later. The non-image analysis image processing unit 502 performs image conversion of character codes, half-tone processing, and the like, converts the image into bit maps, and transfers the data to the image signal generation unit 100. The image processing unit 500 may be included in the image forming apparatus 9, or be connected to the image signal generation unit 100 so as to transmit/receive image data to/from each other.

In the image forming apparatus 9 of Example 1, the non-image analysis image processing unit 502 processes data at a resolution of 600 dpi. The image analysis unit 501 of Example 1 performs calculation processing on image data after processing by the non-image analysis image processing unit 502 ends. The image processing sequence, however, is not limited to this, and may be selected appropriately.

The fixing temperature required for an image to be printed differs depending on the printing ratio. Essentially as the printing ratio is higher, the amount of toner melted by the fixing nip increases, hence a higher temperature control value is needed. Further, even if the printing ratio is the same, the required fixing temperature value changes depending on whether the image is continuous and the degree of discreteness of the image is low (e.g. solid image), or the small dots and fine lines discretely exist and the degree of discreteness is high (e.g. character image). Generally, the character image is more easily fixed. This is because in the case of a toner image that exist discretely, fixability improves due to the heat that enters from peripheral regions where no toner image exists. Further, in Example 1, the toner laid on level is higher, and a higher temperature control value is needed in the case of a small dot or fine line at the center in the main scanning direction, compared with a small dot or fine line at the edges in the main scanning direction, as illustrated in FIG. 5.

In Example 1, each pixel in a print image is classified based on the ratio of pixels having at least a predetermined density which are continuous in a predetermined region (continuity), and on the ratio of pixels having at least a predetermined density in a predetermined region (coverage ratio). Each pixel in the print image is classified into type 1 (small dot or fine line=easy to fix) and type 2 (solid=difficult to fix). Furthermore, for regions divided in the main scanning direction, a number of printing pixels in type 1 and in type 2 are counted, and the temperature control value is determined considering the difference in the toner layered state with respect to the main scanning direction, as illustrated in FIG. 5. Thereby a more accurate fixing temperature value can be calculated, and power consumption can be reduced while ensuring a necessary fixing performance.

Figure 9:
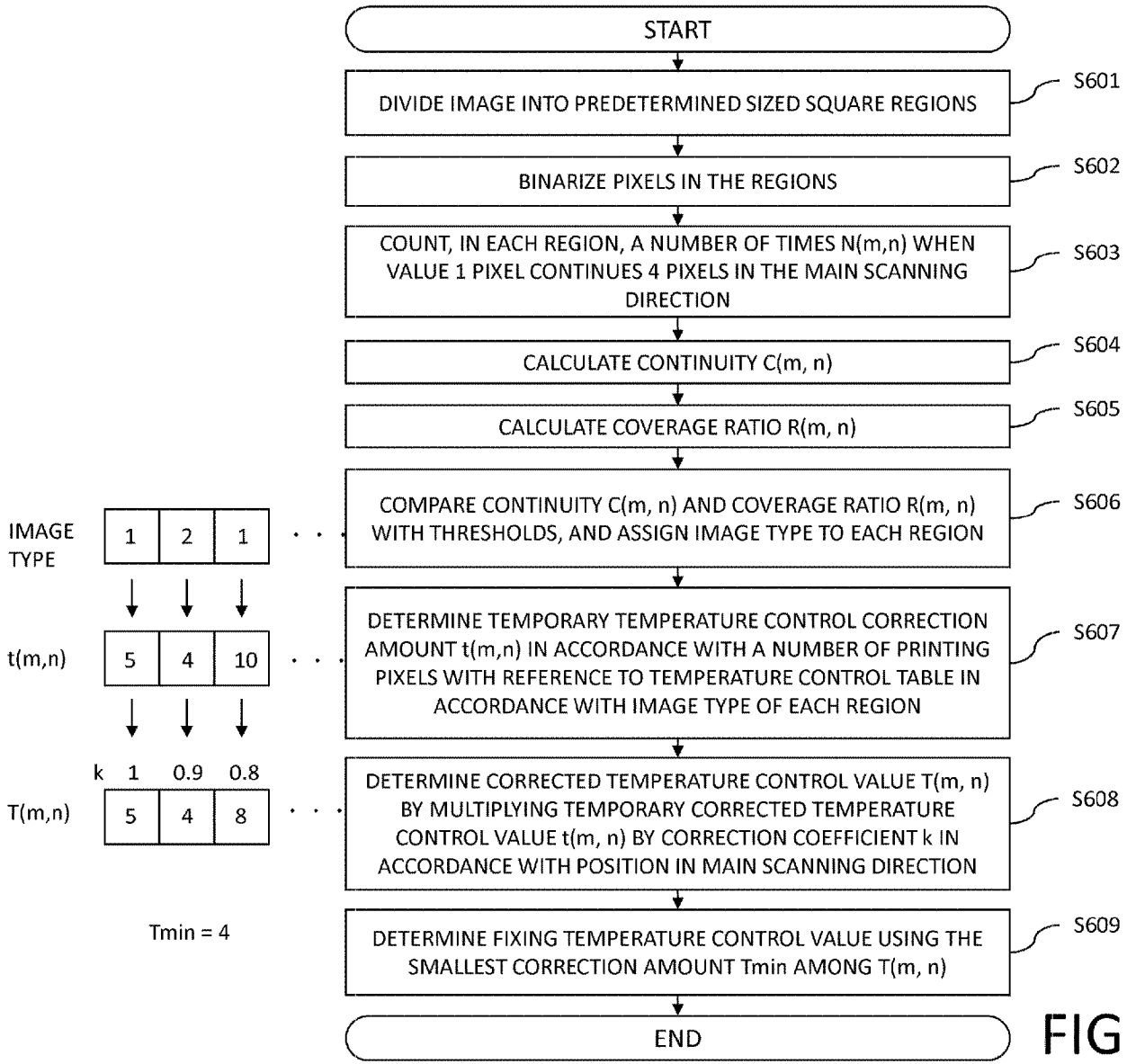
FIG. 9 is a flow chart indicating calculation of a required fixing temperature according to Example 1.

The method of calculating a required fixing temperature value in the image analysis unit 501 will be described with reference to FIG. 9 to FIG. 13E. FIG. 9 is a flow chart indicating a method of calculating the required fixing temperature value according to Example 1.

Image Type Determination Flow

Figure 10:
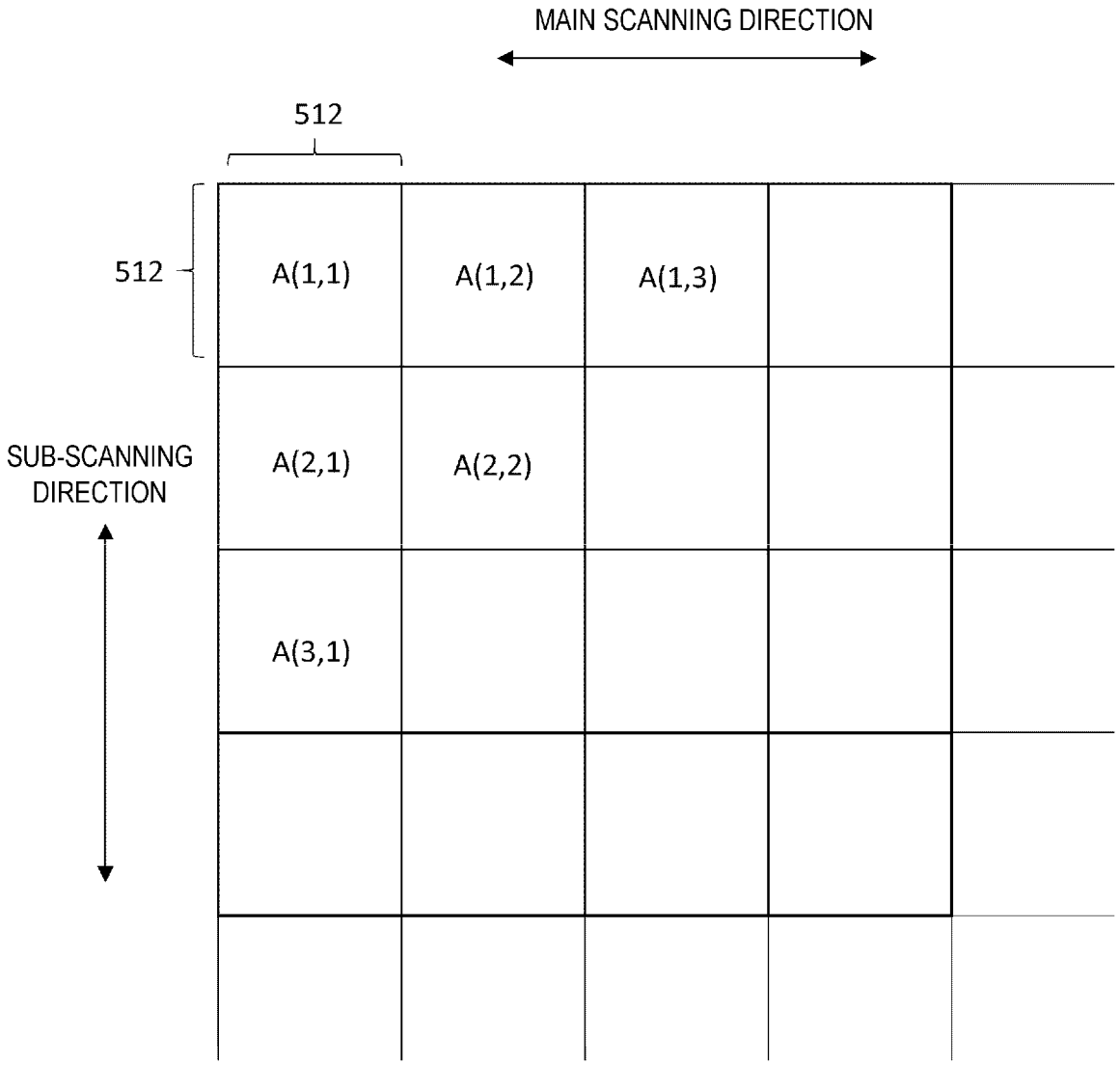
FIG. 10 is a diagram depicting divided regions in step S601 of Example 1.

In step S601, an original image (600 dpi) is divided into square regions each of which has a predetermined size, as illustrated in FIG. 10. Here the predetermined size is assumed to be 512 pixels in the main scanning direction (lateral direction in FIG. 10)×512 pixels in the sub-scanning direction (longitudinal direction in FIG. 10). In Example 1, the original image is divided into regions each of which is 512 pixels×512 pixels, but the size of the divided region is not limited to this. The size of the divided region is preferably about 10 to 2000 pixels. Because if the region is too small, a character may be recognized as a solid image, and if the region is too large, on the other hand, a case where a character and solid image are mixed in the region may not be correctly recognized. In Example 1, the region is a square, but may be a region having a different shape, such as a rectangle.

Each of the divided regions is expressed as A (m, n), where m is a number of the region A in the longitudinal direction (sub-scanning direction), and n is a number of the region A in the lateral direction (main scanning direction). m is a number counted from the front edge of the recording material, and n is a number counted from the left edge of the recording material, and both are 1 or greater positive integers. The printer of Example 1 is an A4 printer, and paper up to letter size (8.5 inches=5100 pixels in the main scanning direction) can be fed, hence the original image is divided into a maximum of 10 regions in the main scanning direction. Regions at the right edge and the bottom edge are smaller than the other regions because the right edge and the bottom edge of each paper become boundaries of the regions. For example, the length of the region A (m, 10) at the right edge in the main scanning direction is not 512 pixels but 492 pixels. The region at the bottom edge also has a smaller number of pixels in accordance with the paper size. The total number of pixels in each region is assumed to be Pa. Then in Example 1, Pa=512×512=262144 in a normal region. If n=1, a plurality of regions divided in the main scanning direction are formed.

In step S602, the pixels in each region are binarized into 0 and 1. In Example 1, binarization is performed such that a pixel of which original density data value is 0, i.e., white pixel is 0, and such that other pixels are 1. In other words, a predetermined density of the pixel is regarded as 1, a pixel of which density is lower than this predetermined density is 0, and a pixel of which density is the predetermined density or higher is 1. The threshold of the predetermined density, however, is not limited to this, but may be a different threshold. Further, instead of binarization, the pixels in the region may be classified into 3 or more ranks using a plurality of thresholds, so as to perform the image analysis.

Figure 11A:
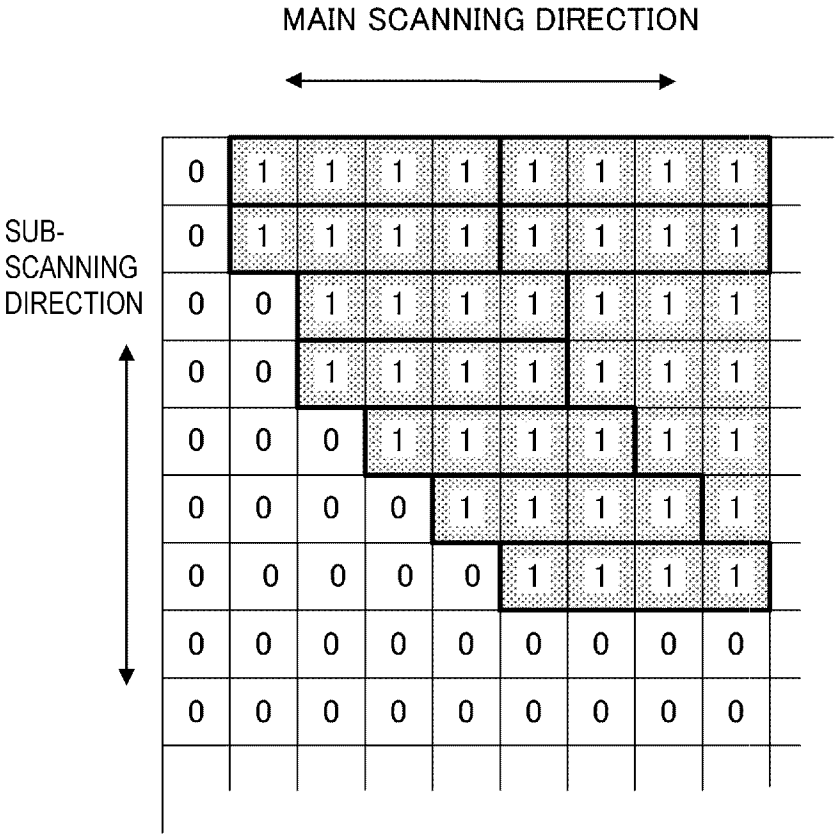
FIG. 11A and FIG. 11B are diagrams depicting continuous pixel counting in step S603 of Example 1.
Figure 11B:
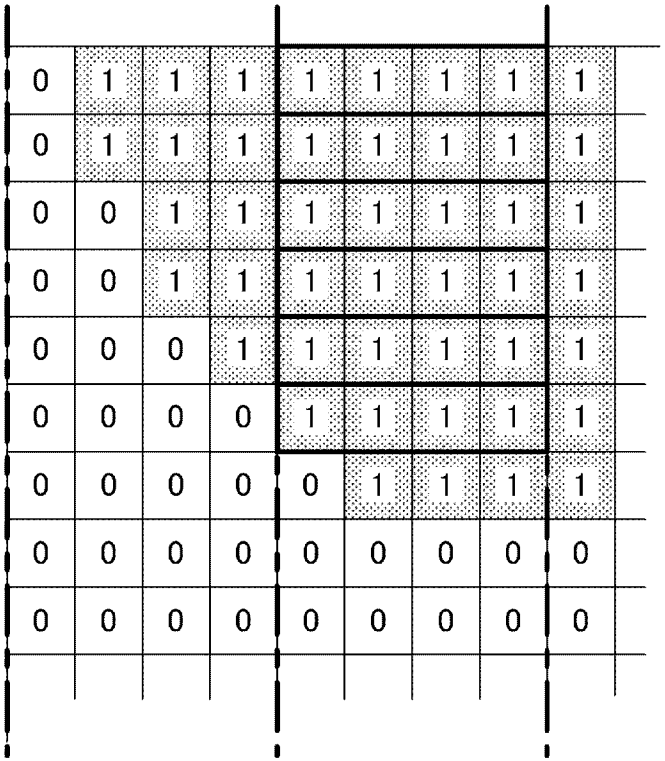

In step S603, as illustrated in FIG. 11A, a number of times when a pixel, of which binarized value is 1, continues for at least 4 pixels in the main scanning direction (hereafter referred to as "number of occurrences of continuation") N(m, n), is counted in each region. The number of pixels that continue is preferably about 3 to 30 pixels. If this value is too small, cases where a character is determined as a solid in error increases, and if this value is too large, cases where a character having a thick line width, which is hard to be fixed, is determined as a regular character increases. The method of counting the number of occurrences of continuation may be to determine whether continuation occurs or not within a range divided in the main scanning direction in advance, as illustrated in FIG. 11B, or may be selected considering convenience during processing.

In step S604, a continuity C(m, n), which indicates a degree of continuity, is calculated using Expression (4), where the numerator is a number of occurrences of continuation N(m, n) counted in step S603×4, and the denominator is a number of pixels P(m, n) of which binarized value is 1 in the region. In the case of P(m, n)=0, C(m, n)=0 as well. The continuity C(m, n) has a value in a range of 0 to 1.

$$C(m,n)=N(m,n)\times 4/P(m,n) \tag{4}$$

In step S605, a coverage ratio R(m, n), which indicates a degree of printing with pixels having at least a predetermined density, is calculated using Expression (5), where the numerator is a number of pixels P(m, n) of which binarized value is 1 in the region, and the denominator is a number of all the pixels Pa in the region. The coverage ratio R(m, n) has a value in a range of 0 to 1.

$$R(m,n)=P(m,n)/Pa \tag{5}$$

Here, as mentioned above, the continuity C and the coverage ratio R are determined as the analysis result of the image data.

In step S606, in each region, the continuity C(m, n) is compared with a continuity threshold Cth, and the coverage ratio R(m, n) is compared with a coverage ratio threshold Rth respectively, and if both are less than the respective threshold, this region is determined as image type 1. If at least one is the threshold or more, then this region is determined as the image type 2. In Example 1, Cth=0.8 and Rth=0.25.

Image Type Determination

Image type determination based on the continuity and the coverage ratio according to Example 1 will be described with reference to FIG. 12.

The image type 1, of which continuity and coverage ratio are both low, is likely to correspond to an image which discreteness is high and coverage ratio is low, such as an image that includes a large number of characters and is easily fixed. The image 2, on the other hand, is likely to correspond to an image which is continuous and is difficult to be fixed, such as a solid image.

Figure 12:
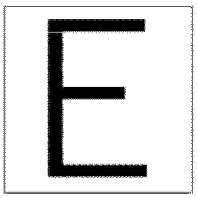
FIG. 12 indicates an example of determining an image type according to Example 1.
Figure 12:
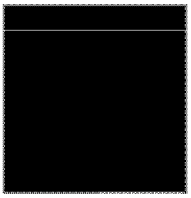
Figure 12:
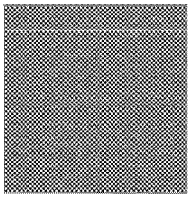

FIG. 12 indicates various types of images 1 to 4. The image 1 is gothic 10 point characters, where both the continuity C and the coverage ratio R are below the thresholds (threshold determination: N), hence the image 1 is determined as the image type 1. The image 2, on the other hand, is a gothic 72 point character, where the coverage ratio R is below the threshold but the continuity C exceed the threshold (threshold determination: Y), hence the image 2 is determined as the image type 2. Here it is accurately determined that the image 2 indicates that even if this is a character, a character having a high point number has a thicker line width and the fixing becomes difficult.

FIG. 3 is a solid on the entire surface in the region, where both the continuity C and the coverage ratio R are 1, that is, exceed the threshold, hence the image 3 is determined as the image type 2. The image 4 is a pattern where each dot is disposed in a checkered pattern, and the continuity C is 0, which is below the threshold. The coverage ratio R, on the other hand, is 0.5, which exceeds the threshold, hence the image 4 is determined as the image type 2. In this way, a pattern, of which degree of discreteness is high but the coverage ratio is high as well is an image that is difficult to be fixed, compared with an image of characters, and even such an image type can be appropriately determined according to Example 1. If Cth is set to a large value, larger font sized characters can be included in the image type 1. If Rth is set to a large value, a higher density of characters can be included in the image type 1. In Example 1, Cth and Rth are set such that a text image constituted of 12 point or smaller characters, which can be easily fixed, is included in the image type 1 as much as possible.

Temperature Control Value Determination Flow

In step S607, a temporary temperature control correction amount t(m, n) of each region is determined with reference to an image type-based temperature control correction table for each region. The temporary temperature control correction amount t(m, n) is a correction amount in the minus direction, indicating the degree which the fixing temperature control value of a solid image can be decreased. As a number of pixels P(m, n) to be printed in each region is higher, t(m, n) decreases, and a higher temperature control value is set. Further, as mentioned above, the image type 1 is an image that is more easily fixed, hence the temporary temperature control correction amount is large even if P(m, n) is the same. Table 1 indicates the temporary temperature control correction table.

TABLE 1

| | TEMPORARY TEMPERATURE CONTROL CORRECTION AMOUNT t(m, n) | |
|---|---|---|
| P(m, n) | IMAGE TYPE 1 | IMAGE TYPE 2 |
| 2500 OR LESS | 12 | 12 |
| 2501-5000 | 10 | 5 |
| 5001-10000 | 8 | 4 |
| 10001-20000 | 6 | 3 |
| 20001-40000 | 4 | 2 |
| 40001-65536 | 2 | 1 |
| 65536 OR MORE | 0 | 0 |

Then in step S608, the position in the main scanning direction is corrected, and the corrected temperature control value T(m, n) is determined for each region. As mentioned above, for the image type 1 in particular, the temporary corrected temperature control value t(m, n) is multiplied by a coefficient k1, considering that the toner laid-on state on paper is different between the center and the edges in the main scanning direction. The coefficient k1 has a value indicated in Table 2 with respect to a region A(x, n) (x is an arbitrary number in the sub-scanning direction). The corrected temperature control value T(m, n) is an integer (rounded off). A correction coefficient k2 for the image type 2 is a constant value with respect to the main scanning direction, because the toner laid-on state of a solid image on the paper is approximately uniform in the main scanning direction. In other words, for the image type 2, the corrected temperature control value T(m, n) is not weighted in the main scanning direction. Table 2 indicates the correction coefficient k table.

TABLE 2

| A(x, n) | 1 | 2 | 3 | 4 | 5 | 6 | 7 | 8 | 9 | 10 |
|---|---|---|---|---|---|---|---|---|---|---|
| k1 | 1 | 0.9 | 0.8 | 0.7 | 0.6 | 0.6 | 0.7 | 0.8 | 0.9 | 1 |
| k2 | 1 | 1 | 1 | 1 | 1 | 1 | 1 | 1 | 1 | 1 |

Then in step S609, the smallest correction amount Tmin in the T(m, n) of the entire region is selected, and a fixing temperature control value is determined using this correction amount. In Example 1, the smallest correction amount corresponds to the highest fixing temperature. For example, it is assumed that the image type of the region A(5, 3) is the image type 1, and P(5, 3)=7000. In this case, t(5, 3)=8 according to Table 3, and the correction coefficient k=0.8 according to Table 4. Therefore, the decimal of "8×0.8=6.4" is rounded down, and T(5, 3)=6 is determined. If Tmin=6, the temperature control value for the solid image is 200° C. in Example 1, hence the fixing temperature control value is 194° C.

Fixability Evaluation Method

In order to confirm the effects of Example 1, 10 pages of image A to image E, indicated in FIG. 13A to FIG. 13E, were printed continuously respectively in an environment of a 25° C. temperature and a 50% humidity, and fixability and power consumption were evaluated. The image A to image D in FIG. 13A to FIG. 13D are all images of which printing ratio is 8%, and the image E in FIG. 13E is a solid black image of which printing ratio is 100%. In the image A and image B in FIG. 13A and FIG. 13B, the characters are written in a larger font size for better visibility, but actual images thereof are constituted only of 10 pt characters. Using A4 sized paper (80 g/cm$^2$ Red Label paper manufactured by Canon), the fixability was evaluated by visual observation.

Guidelines of the fixability evaluation are as follows.

○ . . . No image defects were caused by a fixing defect, therefore there are no problems.

Δ . . . Black dots caused by a fixing defect were slightly observed, but this presented no problems in practical terms.

x . . . Many black dots caused by a fixing defect were observed. Further, toner partially attached to the fixing film 13, and toner contamination was observed in the margin portion at the rear edge of the image, hence is NG in practical terms.

Power was measured by connecting a power meter (digital power meter WT310, manufactured by Yokogawa Text & Measurement Corp.) to the heater 11, and reading the measured value after printing 10 pages continuously. To impartially compare the fixability evaluation and power values, sufficient time was allotted after the previous testing, then after confirming that the temperature of the thermal fixing apparatus 6 dropped to approximately room temperature, the next testing was performed. Testing and comparison was also performed for the following Comparative Examples 1 and 2 in the same manner.

Comparative Example 1

In Comparative Example 1, a method of determining target temperature T based on the printing ratio of an entire image, just like Japanese Patent Application Laid-open No. 2016-004231, is used. The configuration of the apparatus is the same as Example 1. Table 3 is a temperature control table according to Comparative Example 1, and indicates the relationship between the printing ratio and the target temperature T (° C.).

TABLE 3

| | PRINTING RATIO (%) | | | | | | | | | | | | |
|---|---|---|---|---|---|---|---|---|---|---|---|---|---|
| | 1% OR LESS | 2 | 3 | 4 | 5 | 6 | 7 | 8 | 9 | 10 | 11 | 12 | 12% OR MORE |
| TEMPERATURE CONTROL VALUE (° C.) | 188 | 189 | 190 | 191 | 192 | 193 | 194 | 195 | 196 | 197 | 198 | 199 | 200 |

Comparative Example 2

In Comparative Example 2, a fixability evaluation similar to Example 1 was performed with uniformly setting the correction coefficient k1 to 0.5 for the image type 1 in step S608 in FIG. 9.

Testing Results

Table 4 indicates the evaluation results of Example 1, Comparative Example 1 and Comparative Example 2. Example 1 is successful in controlling the temperature and reducing power consumption while satisfying the level of fixability for each image. In Comparative Example 1, the same fixing temperature control value is set for the image A to image D of which the printing ratio is 8%, hence a fixing defect occurred in the image D where a toner image concentrates to one location.

Further, in Example 1, in the image A, character images having a low toner height at the edges in the main scanning direction are detected, and the temperature control value is appropriately decreased. In Comparative Example 1, on the other hand, an excessively high fixing temperature control value is set for the image A, hence power consumption is high. In Comparative Example 2, solid images (image C and image D), which are determined as both an image type 2, are controlled in the same manner as Example 1, but in the image A, an excessively high temperature control value is set and power consumption is high, since correction depending on the position in the main scanning direction is not performed. As a consequence, Example 1 is advantages over the comparative examples in terms of improving fixability and reducing power consumption.

member), and the like are disposed. The developing roller includes a conductive elastic layer on the surface in order to ensure contact with the photosensitive member. The developing roller is disposed to contact with a photosensitive drum, and is rotary-driven so that the moving directions of the photosensitive drum and the developing roller become the same at this contact portion.

The developing blade is a phosphor bronze plate (metal thin plate) having a spring elasticity coated with an elastic member, and is in contact with the surface of the developing roller at a predetermined linear pressure, so as to maintain the toner coating amount on the developing roller at an appropriate level. For the toner supply roller, an elastic roller, which is a core metal surrounded by a sponge structured urethane foam, is used. The toner supply roller is disposed in contact with the developing roller, and is rotary-driven so that the moving directions of the developing roller and the toner supply roller become the opposite (counter directions) at the contact portion.

In Modification 1, the toner, that is regulated by the developing blade and is laid on the developing roller, is a non-magnetic single component developer prepared by a suspension polymerization method. Therefore, the only forces that constrain the toner on the developing roller are the reflection force generated by the electric charges of the toner, and a slight Van der Waal's force. Therefore, if the toner layer on the developing roller becomes thick, the reflection force to the toner on the upper layer portion of the toner layer becomes weak, and in this case, toner cannot be laid on the developing roller, and as a result toner scatters.

TABLE 4

| | EXAMPLE 1 | | | COMPARATIVE EXAMPLE 1 | | | COMPARATIVE EXAMPLE 2 | | |
|---|---|---|---|---|---|---|---|---|---|
| | FIX-ABILITY | TEMPERATURE CONTROL VALUE (° C.) | POWER (Wh) | FIX-ABILITY | TEMPERATURE CONTROL VALUE (° C.) | POWER (Wh) | FIX-ABILITY | TEMPERATURE CONTROL VALUE (° C.) | POWER (Wh) |
| IMAGE A | ○ | 188 | 2.42 | ○ | 195 | 2.60 | ○ | 193 | 2.55 |
| IMAGE B | ○ | 193 | 2.55 | ○ | 195 | 2.60 | ○ | 193 | 2.55 |
| IMAGE C | ○ | 196 | 2.62 | ○ | 195 | 2.60 | ○ | 196 | 2.62 |
| IMAGE D | ○ | 200 | 2.72 | Δ | 195 | 2.60 | ○ | 200 | 2.72 |
| IMAGE E | ○ | 200 | 2.72 | ○ | 200 | 2.72 | ○ | 200 | 2.72 |

Modification 1

In Modification 1, non-magnetic single component contact developing is used for the developing system. As described in FIG. 6A and FIG. 6B, in the case of the contact developing system, the change of the toner laid-on level caused by the laser spot diameter is smaller than the jumping developing system. Portions that are different from Example 1 will be described below.

The developing apparatus of Modification 1 will be described. In the developing apparatus, a developing roller (developer bearing member), a developing blade (developer regulating member), a toner supply roller (developer supply Hence the toner layer on the developing roller must be controlled to be thin, but in some cases, this may make it difficult to acquire sufficient image density. In such a case, sufficient image density may be acquired by setting the peripheral velocity of the developing roller to be faster than the peripheral velocity of the photosensitive drum. For this peripheral velocity ratio, it is preferable that the peripheral velocity of the developing roller is 1.1 to 3 times the peripheral velocity of the photosensitive drum. In Modification 1, this peripheral velocity ratio is 1.3 times.

For the developing bias, a −300V DC voltage is applied. As mentioned above, for the solid image, the toner on the developing roller is developed onto the surface of the photosensitive member almost 100%.

Table 5 indicates the correction coefficients k1 and k2 of Modification 1. Compared with the jumping developing system, the contact developing system is less influenced by the laser spot diameter, hence the height of the toner dot at the center in the main scanning direction is only slightly higher than the edges, and the difference of fixability in the image type 1, between the center portion and the edges, is relatively small. Therefore, the correction coefficient at the center portion in the main scanning direction is set to be higher than Example 1.

TABLE 5

| A(x, n) | 1 | 2 | 3 | 4 | 5 | 6 | 7 | 8 | 9 | 10 |
|---|---|---|---|---|---|---|---|---|---|---|
| k1 | 1 | 0.95 | 0.90 | 0.85 | 0.8 | 0.8 | 0.85 | 0.90 | 0.95 | 1 |
| k2 | 1 | 1 | 1 | 1 | 1 | 1 | 1 | 1 | 1 | 1 |

Table 6 indicates a result after the same fixability evaluation as Example 1 was performed. Compared with Example 1, in image B where text is disposed at the center in the main scanning direction, the correction amount can be increased, therefore the power consumption can be reduced.

TABLE 6

| | MODIFICATION 1 | | |
|---|---|---|---|
| | FIXABILITY | TEMPERATURE CONTROL VALUE (° C.) | POWER (Wh) |
| IMAGE A | ○ | 188 | 2.42 |
| IMAGE B | ○ | 191 | 2.50 |
| IMAGE C | ○ | 196 | 2.62 |
| IMAGE D | ○ | 200 | 2.72 |
| IMAGE E | ○ | 200 | 2.72 |

In Modification 1, the non-magnetic toner is used, but magnetic toner may be used for the contact developing system. For other developing systems (e.g. two-component developing system) as well, optimum fixing temperature control values can be calculated by adjusting the correction coefficient k in accordance with the developing characteristic.

In Example 1, small dots or a solid are determined based on the continuity and coverage ratio of the dots, but the image type may be determined based on the font or size of the characters, or on the object type (e.g. photograph). Example 1 and the comparative examples were described using a monochrome printer as an example, but the present invention is also applicable to color printers.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-165945, filed Sep. 30, 2020, which is hereby incorporated by reference wherein in its entirety.

What is claimed is:

1. An image forming apparatus comprising:

a scanning unit that scans a surface of a photosensitive member with light and forms a latent image in accordance with image data;

a developing unit that supplies toner to the latent image and develops the latent image as a toner image;

a fixing unit that heats and fixes the toner image transferred to a recording material; and a control unit that controls a fixing temperature, which is a temperature at which the fixing unit heats the toner image, on the basis of the image data, wherein a scanning velocity of the scanning unit changes depending on a position to be scanned, the control unit analyzes a printing ratio by dividing the image data into a plurality of regions in a main scanning direction in which the scanning unit scans the surface of the photosensitive member with the light, and determines the fixing temperature on the basis of the position in the main scanning direction and the printing ratio for each of the plurality of regions, in a case where an image having a first printing ratio is formed in a first region corresponding to a center portion in the main scanning direction, the fixing temperature is set to a first temperature, and in a case where the image having the first printing ratio is formed in a second region corresponding to an edge portion closer to an edge than the center portion, the fixing temperature is set to a second temperature, and the first temperature is higher than the second temperature.

2. The image forming apparatus according to claim 1, wherein the control unit calculates a correction amount to determine the fixing temperature on the basis of the position in the main scanning direction and the printing ratio for each of the plurality of regions, and selects the correction amount from a plurality of respective correction amounts, each respective correction amount of the plurality of respective correction amounts calculated for a respective region of the plurality of regions, and the control unit determines the fixing temperature at least by selecting the correction amount from the plurality of respective correction amounts so that the fixing temperature becomes highest among the plurality of respective correction amounts.

3. The image forming apparatus according to claim 2, wherein the control unit determines an image type for each of the plurality of regions and changes the correction amount depending on the image type.

4. The image forming apparatus according to claim 3, wherein the control unit determines whether the image type is an image of which degree of discreteness is low or an image of which degree of discreteness is high, and calculates the correction amount so that the fixing temperature becomes high in a case where the degree of discreteness of the image type is determined to be low, and the fixing temperature becomes low in a case where the degree of discreteness of the image type is determined to be high, in the calculation of the correction amount.

5. The image forming apparatus according to claim 4, wherein the control unit compares density of each pixel included in each of the plurality of regions with a threshold, calculates continuity, which indicates a degree of continuation of pixels having at least a predetermined density, and a coverage ratio, which indicates a degree of printing with pixels having at least the predetermined density, and determines an image type of each of the plurality of regions on the basis of the continuity and the coverage ratio.

6. The image forming apparatus according to claim 5, wherein in a case where the continuity and the coverage ratio calculated for a respective region of the plurality of regions are both less than respective predetermined thresholds, the control unit determines that the respective region is an image type having a low degree of discreteness.

7. The image forming apparatus according to claim 4, wherein the image having a high degree of discreteness is an image including a character, and the image having a low degree of discreteness is a solid image.

8. The image forming apparatus according to claim 4, wherein for each of the plurality of regions, the control unit calculates the respective correction amount of the plurality of respective correction amounts so that the fixing temperature becomes lower as the region is closer to an edge in the main scanning direction, in a case where the degree of discreteness in the region is determined to be high.

9. The image forming apparatus according to claim 8, wherein for each of the plurality of regions, the control unit calculates the respective correction amount of the plurality of respective correction amounts regardless of the position of the region in the main scanning direction, in a case where the degree of discreteness in the region is determined to be low.

10. The image forming apparatus according to claim 2, wherein the control unit calculates the correction amount so that the fixing temperature becomes higher as the printing ratio in the region becomes higher.

11. The image forming apparatus according to claim 2, wherein for each of the plurality of regions, the control unit calculates the respective correction amount of the plurality of respective correction amounts so that the fixing temperature becomes lower as the region is closer to an edge in the main scanning direction.

12. The image forming apparatus according to claim 1, wherein a jumping developing system is used for the developing unit.

13. The image forming apparatus according to claim 1, wherein the scanning unit does not include a lens having an fθ characteristic.

14. The image forming apparatus according to claim 1, wherein the control unit corrects, by clock correction or pixel segment insertion/extraction correction, a change of pixel density in the main scanning direction, caused by a change of the scanning velocity of the scanning unit.

15. The image forming apparatus according to claim 14, wherein the control unit corrects the density of each pixel in the main scanning direction by brightness correction or image data correction.

16. The image forming apparatus according to claim 1, wherein, in a case where the image having the first printing ratio is formed in the first region and the second region, the fixing temperature is set to the first temperature.

17. The image forming apparatus according to claim 1, wherein the fixing unit includes: a tube-shaped fixing film, a heater disposed on an inner side of the fixing film, and a pressure roller, and the toner image on the recording material is heated via the fixing film at a nip portion formed between the fixing film and the pressure roller.

18. An image forming apparatus comprising:

a scanning unit that scans a surface of a photosensitive member with light and forms a latent image in accordance with image data, wherein a scanning velocity of the scanning unit changes depending on a position of the photosensitive member to be scanned;

a developing unit that supplies toner to the latent image and develops the latent image as a toner image;

a fixing unit that heats the toner image with a heater and fixes the toner image on a recording material; and a control unit that executes:

(1) counting, for each of a plurality of regions obtained by dividing the image data in a main scanning direction, pixels with a predetermined density, (2) setting a target temperature based on (a) a count value of the pixels included in each of the plurality of regions, and (b) a position of each of the plurality of regions in the main scanning direction, wherein, in a case where a first number of pixels with the predetermined density is included in a center region of the plurality of regions in the main scanning direction, the target temperature is set to a first temperature, and wherein, in a case where the first number of pixels with the predetermined density is included in an end region of the plurality of regions in the main scanning direction, the target temperature is set to a second temperature which is lower than the first temperature, and, (3) controlling power supplied to the heater so that a temperature of the heater when fixing the toner image on the recording material is maintained at the target temperature.

19. The image forming apparatus according to claim 18, wherein, in a case where the first number of pixels with the predetermined density is included both in the center region and the end region, the target temperature is set to the first temperature.

20. The image forming apparatus according to claim 18, wherein the control unit counts a number of occurrences of continuation of pixels having the predetermined density in each of the plurality of regions.

21. The image forming apparatus according to claim 18, wherein the control unit determines whether or not the image data is a text image, and the control unit sets the target temperature according to the number of pixels having the predetermined density in each of the plurality of regions, regardless of the position in the main scanning direction when it is determined that the image data is not a text image.

22. The image forming apparatus according to claim 18, wherein the fixing unit includes: a tube-shaped fixing film and a pressure roller, wherein the heater is disposed on an inner side of the fixing film, and the toner image on the recording material is heated via the fixing film at a nip portion formed between the fixing film and the pressure roller.

* * * * *